US006260396B1

(12) United States Patent
Henze et al.

(10) Patent No.: US 6,260,396 B1
(45) Date of Patent: Jul. 17, 2001

(54) 2-ROLL PIERCING MILL AND METHOD OF PRODUCING HOLLOW BLOCKS FROM HIGH ALLOY STEELS

(75) Inventors: Werner Henze, Langenfeld; Jürgen Pietsch, Mönchengladbach, both of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/491,822

(22) Filed: Jan. 26, 2000

(30) Foreign Application Priority Data

Jan. 26, 1999 (DE) ..... 199 03 974

(51) Int. Cl.[7] ..... B21B 17/10

(52) U.S. Cl. ..... 72/209; 72/208; 72/97; 72/250

(58) Field of Search ..... 72/209, 208, 250, 72/97, 366.2, 370.04

(56) References Cited

U.S. PATENT DOCUMENTS 4,006,618 * 2/1977 Yanagimoto et al. ..... 72/209
4,078,412 * 3/1978 Way et al. ..... 72/250
5,983,689 * 11/1999 Yorifuji et al. ..... 72/42

* cited by examiner

*Primary Examiner*—Ed Tolan
(74) *Attorney, Agent, or Firm*—Cohen, Pontani, Lieberman & Pavane

(57) ABSTRACT

A 2-roll piercing mill for producing hollow blocks from a rolled material comprising high alloy steels has guide tools for the rolled material. The guide tools are arranged for closing a reforming zone of the piercing mill transversely with respect to the rolling axis as the hollow block is pierced. In this arrangement, each of the guide tools includes a base body made of a carrier material and a working face made of a material that has antiadhesive properties with respect to high alloy steels and high hot strength. Prior to the piercing operation, the temperature of either the working face or the entire guide tool is raised above room temperature to avoid high thermal stresses.

11 Claims, No Drawings

2-ROLL PIERCING MILL AND METHOD OF PRODUCING HOLLOW BLOCKS FROM HIGH ALLOY STEELS

BACKGROUND OF THE INVENTION

1. Field of the Invention

The invention relates to a 2-roll piercing mill for producing hollow blocks from high alloy steels. The 2-roll piercing mill has guides for the rolled material that close the reforming zone transversely with respect to the rolling axis as the hollow block is pierced.

2. Description of the Related Art

The state of the art of the piercing rolling method and the metallurgical production process presently allows production of seamless pipes of good quality from high alloy ferritic, ferritic/martensitic and austenitic steels by piercing on the piercing mill. This method has some advantages by comparison with the conventional extrusion process. The advantages of the piercing rolling method result from omitting the operation step of boring out the blocks, increasing the usable weights of the blocks and reducing the eccentricity and therefore the wall thickness tolerance. A conical piercing mill having guide shoes for closing the reforming zone transversely with respect to the rolling axis is particularly suitable for piercing high alloy steels, as has already been introduced by R. C. Stiefel. This method produces higher stretch values, thereby allowing the production of relatively thin-walled hollow blocks, which is not possible to the same extent using a 3-roll piercing mill or a 2-roll piercing mill with guide disks.

However, high alloy steels have a high tendency to adhesion (that is to say to the welding or deposition) of block material onto the operating face of the guides. The material which adheres firmly to the working face of the guides (referred to as pick ups) leads to mechanical damage in the form of deep, sharp-edged, spiral ridges on the outer surface of the perforated hollow blocks that are being formed. The mechanical damage must then be removed by grinding, skinning or turning down, which entails high material losses and additional operating outlay.

A specific application of a lubricating and release agent to the guides may avoid or at least delay the production of the material deposits. However, the lubricating agent may inadvertently be transferred to the working rolls, so that slipping (slip) between the rolls and roll material occurs. The slipping may lead to the abortion of the piercing operation.

The above mentioned slip may be avoided by supplying a liquid containing an Si carbide. However, this solution requires an additional device and an additional medium.

Some trials using guide shoes made of gray cast iron GGG and GGL showed a certain suitability with regard to adhesion, but their friction and wear behavior was unsatisfactory for production operation.

SUMMARY OF THE INVENTION

The object of the present invention is to be seen as finding an effective and cost-effective route to avoid the damaging adhesions on the working faces of the guide tools for high-alloy steels.

Therefore, the present invention proposes that the guide tools each be composed of a base body comprising a carrier material and a working face comprising a material that has antiadhesive properties with respect to high alloy steels and a high hot strength. In practice, the working face of the guide tools is coated with a material which does not participate in any adhesion with the pipe material or the rolled material and, because of its particular properties, exhibits a self-lubricating effect.

Although a similar solution was proposed for a different purpose in DE-PS 31 14 177 C2, highly heat-resistant hard material layers were produced on a base body, but are not able to solve the problem of avoiding the adhesion of high-alloy steel to the guide tools.

The various features of novelty which characterize the invention are pointed out with particularity in the claims annexed to and forming a part of the disclosure. For a better understanding of the invention, its operating advantages, and specific objects attained by its use, reference should be had to the descriptive matter in which there are described preferred embodiments of the invention.

DETAILED DESCRIPTION OF THE PRESENTLY PREFERRED EMBODIMENTS

The present invention comprises a guide tool for a piercing mill comprising a base body made of a carrier material and a working face made of a material that has antiadhesive properties with respect to rolling material made of high alloy steels and a high hot strength. The guide tool according to the present invention may be incorporated equally successfully in the form of shoes, disks or rollers.

Particularly beneficial properties for achieving the object according to the invention are possessed by a work face made of the material molybdenum or a molybdenum-based alloy.

It is adequate for the working face to have a thickness between 0.1 and 10 mm. However, in accordance with a preferred embodiment of the invention, the thickness of the working face is selected such that the magnitudes of the thermal expansion of the working face and of the base body at their contact faces at working temperature are substantially identical, so that no thermal stresses and separation of the working face occur.

The working face is connected to the base body so that it does not rotate with the rolling material in the piercing mill with respect to the base body. According to a first embodiment of the invention, the connection between the base body and the material of the working face may be made in a form-fitting manner. However, the connection may also be made by defined roughening of the contact faces between the working face and the base body. It is also conceivable to produce the connection of the working face to the base body by jointing or to apply the working face to the base body by thermal spraying (flame, plasma spraying). A further connection embodiment comprises producing the working part by hot isostatic pressing or cold isostatic pressing and powder-metallurgical sintering.

It is beneficial if the carrier material of the base body comprises a higher-strength steel or an alloy based on iron, nickel or cobalt. The base body may alternatively consist completely of the material of the working face. In the latter case it is beneficial if the entire guide tool consists monolithically of molybdenum or the molybdenum-based alloy.

The method of producing hollow blocks from high-alloy steels using the guide tools according to the present invention provides for the working face or the entire guide tool, before being used in accordance with the invention, to be brought to a temperature above room temperature to avoid high thermal stresses.

For the same reason, before and after the piercing operation, and during the piercing, the guide tool should be protected from contact with cooling water by suitable measures, such as compressed-air nozzles or mechanical coverings. It is also conceivable for the cooling and the protection of the guide tools from contact with water to be provided by blowing on an inert gas, for example nitrogen.

After the piercing operation, the roll cooling should be interrupted until the start of the next piercing operation. The interruption of the roll cooling may, for example, be performed automatically.

From an economic and ecological point of view it is expedient if worn working faces are regenerated, following the removal of material, and the material of the working face is recovered by mechanical or thermal separation or by melting down the material of the base body.

The invention is not limited by the embodiments described above which are presented as examples only but can be modified in various ways within the scope of protection defined by the appended patent claims.

We I claim:

1. A 2-roll piercing mill for producing hollow blocks from rolled material made of high alloy steels in a reforming zone of the 2-roll piercing mill, comprising guide tools for guiding the rolled material, said guide tools operatively arranged for closing the reforming zone transversely with respect to a rolling axis of the rolled material as the rolled material is pierced to form the hollow block, wherein each of said guide tools comprise a base body made of a carrier material and a working face mounted on said base body for contacting the rolled material, said working face being made of a material that has antiadhesive properties with respect to the rolled material made of high alloy steels and has a high hot strength, wherein said working face and said base body of each of said guide tools contact each other via contact faces and a thickness of said working face is selected such that a magnitude of thermal expansion of said working face and a magnitude of thermal expansion of said base body at said contact faces between said base body and said working face are substantially identical at a working temperature of said guide tool.

2. The 2-roll piercing mill of claim 1, wherein the guide tools comprise one of shoes, disks and rollers.

3. The 2-roll piercing mill of claim 1, wherein said material of said working face comprises one of molybdenum and a molybdenum-based alloy.

4. The 2-roll piercing mill of claim 1, wherein a thickness of said working face is in a range including 0.1 to 10 mm.

5. The 2-roll piercing mill of claim 1, wherein said working face is connected to said base body in a form-fitting connection so that the working face does not move with the rolling material relative to the base body.

6. The 2-roll piercing mill of claim 1, wherein said working face and said base body contact each other via contact faces, and said contact faces comprise a defined roughening for ensuring that said working face is fixedly connected to said base body.

7. The 2-roll piercing mill of claim 1, wherein said working face comprises one of a hot isostatic pressed material pressed onto said base body, a cold isostatic pressed material pressed onto said base body, and a powder-metallurgical sintered material sintered onto base body.

8. The 2-roll piercing mill of claim 1, wherein said working face is connected said base body via jointing.

9. The 2-roll piercing mill of claim 1, wherein said working face is connected to said base body via a thermal spraying comprising one of flame spraying and plasma spraying.

10. The 2-roll piercing mill of claim 1, wherein said carrier material comprises one of a higher-strength steel, an iron-based alloy, a nickel-based alloy, and a cobalt-based alloy.

11. The 2-roll piercing mill of claim 1, wherein said carrier material is the same material as said material of said working face.

* * * * *